United States Patent [19]

Tuckmantel

[11] 4,215,745

[45] Aug. 5, 1980

[54] PARTITIONED HEAT-EXCHANGER SHELL

[75] Inventor: Hans-Joachim Tückmantel, Mülheim an der Ruhr, Fed. Rep. of Germany

[73] Assignee: Kempchen & Co. GmbH, Oberhausen, Fed. Rep. of Germany

[21] Appl. No.: 884,157

[22] Filed: Mar. 7, 1978

[30] Foreign Application Priority Data

Mar. 19, 1977 [DE] Fed. Rep. of Germany ..... 2712207

[51] Int. Cl.[2] ..... F28F 9/22

[52] U.S. Cl. ..... 165/160; 165/164; 165/176

[58] Field of Search ..... 165/160, 161, 159, 158, 165/176, 142, 164

[56] References Cited

U.S. PATENT DOCUMENTS

| | | | |
|---|---|---|---|
| 1,722,109 | 7/1929 | Potter | 165/160 |
| 1,803,034 | 4/1931 | Potter | 165/160 |
| 1,955,006 | 4/1934 | Mateer et al. | 165/160 |
| 2,335,479 | 11/1943 | Berkeley et al. | 165/160 |
| 3,151,674 | 10/1964 | Heller et al. | 165/176 |

FOREIGN PATENT DOCUMENTS

| | | | |
|---|---|---|---|
| 682861 | 11/1952 | United Kingdom | 165/159 |
| 757633 | 9/1956 | United Kingdom | 165/159 |

*Primary Examiner*—Sheldon Richter
*Attorney, Agent, or Firm*—Karl F. Ross

[57] ABSTRACT

A heat-exchanger shell comprises a tube of generally cylindrical shape subdivided by a planar diametral partition plate into a pair of compartments. At each axially extending outer edge of the partition plate there is provided a one-piece seal unitarily formed of a pair of generally parallel inner flanges defining a groove in which the respective outer edge of the plate is snugly received and a pair of oppositely outwardly directed flanges bearing tightly radially outwardly on the inner wall of the tube. The seal may be made of a profiled piece of elastomeric synthetic-resin material, or of a piece of austenitic sheet steel. The shell is assembled by deflecting the inner flanges elastically apart and fitting them over the outer edges of the plate, then sliding the plate with the seals into the tube with simultaneous inward deflection of the outer flanges of the seals.

6 Claims, 5 Drawing Figures

PARTITIONED HEAT-EXCHANGER SHELL

FIELD OF THE INVENTION

The present invention relates to a heat-exchanger. More particularly, this invention concerns a heat-exchanger shell having an internal partition.

BACKGROUND OF THE INVENTION

A heat-exchanger shell is known having a generally cylindrical outer tube provided internally with an axially and longitudinally extending partition. Such shell types include the two-pass shell with longitudinal baffle, the split-flow shell, and the double split-flow shell, as described on page 11-4 of CHEMICAL ENGINNER'S HANDBOOK, by J. H. PERRY (McGraw-Hill: 1963). The partition wall subdivides the interior of the shell into two separate longitudinally extending compartments that normally communicate at one end at least of the shell. For most efficient heat exchange the partition should form a relatively tight seal along both of its longitudinal edges so that flow between the compartments is only possible in the intended regions, that is at the end or ends of the shell.

Typically such a structure has been formed by using a rectangular partition plate having a width slightly smaller than the internal diameter of the tube forming the outer wall of the shell so that the longitudinal outer edges of this plate are spaced slightly radially inwardly from the inner wall surface of the shell when the plate is positioned on a diametral plane. Seals are provided between the longitudinal edges of the partition plate and the tube forming the outer wall of the shell normally in form of austenitic-alloy seal strips that are bolted or riveted to the longitudinal edges of the partition plate. Each such seal strip has a bent-over edge which lies on the internal face of the tube shell. It is also known to mount a stack or several layers of such L-section seal strips, and to allow limited elastic deformation of them. Nonetheless such arrangements typically leak somewhat, in particular at the holes where the mounting screws or rivets for the seal strips are provided. Furthermore the assembly of such an arrangement with the fitting-together of the partition and tube shell is a relatively complex task that often entails considerable production cost.

OBJECTS OF THE INVENTION

It is therefore an object of the present invention to provide an improved heat-exchanger shell.

Another object is the provision of an improved seal for such a shell as well as an improved method of assembling such a shell.

SUMMARY OF THE INVENTION

These objects are attained according to the present invention in a heat-exchanger shell where each of the longitudinal edges of the partition plate is provided with a respective one-piece seal unitarily formed with a pair of generally parallel inner flanges defining a groove in which the respective outer edge of the plate is snugly received and a pair of oppositely outwardly extending flanges bearing tightly radially outwardly on the inner wall. No screws, rivets, or the like are necessary to hold such a sealing strip in place on the partition-plate edge, the mounting being entirely frictional with elastic gripping and engagement of the various flanges with the respective surfaces of the partition plate and tube wall.

Such an arrangement can be assembled very easily by slightly deforming the seal strips to fit them over the edges of the partition plate, then sliding this partition plate axially into the tube shell, with corresponding inward radial deflection of the outer flanges of the seal strip. Once in place an extremely tight seal is produced, while at the same time limited thermal expansion and the like is easily compensated for.

According to further features of the invention the seal is provided with elastomeric seal strips between each of the inner flanges and the facing surface of the plate and or between each of the outer flanges and the inner surface of the tube, so that it is possible to obtain a very tight seal between the partition and the tube.

In accordance with other features of this invention the seals may each be formed unitarily of a profiled piece of a synthetic-resin elastomer. It is also possible in accordance with this invention to form each of the seals of a single profile piece of sheet metal. This is best achieved by doubling over the sheet metal at the inner edge of each of the inner flanges so that each of these inner flanges is doubled, while the outer flanges are a single layer. Furthermore according to this invention an austenitic steel is used for the sheet metal and the groove defined between the inner flanges tapers away from the outer flanges, so that the inner flanges may be elastically pushed apart for insertion of the outer edge of the plate into the groove. In this manner an extremely tight seal is obtained. Furthermore according to this invention in unstressed condition the outer flanges lie either in a common plane or preferably at an obtuse angle to each other flaring away from the inner flanges. Thus these outer flanges must be elastically deflected radially inwardly to a considerable extent for mounting of the partition in the tube. Once again, this ensures a very resilient and tight seal. In fact within the system according to this invention it is possible for the seals alone to constitute the mounting means for the plate.

Finally in accordance with yet another feature of this invention it is possible to form the seal of a stack of geometrically similar sheet-metal seals as described above. The innermost such seal typically has outer flanges somewhat longer than any of the other seals and these outer flanges alone are provided with sealing strips for maximum sealing between the partition and the tube.

SPECIFIC DESCRIPTION OF THE DRAWING

Figure 1:
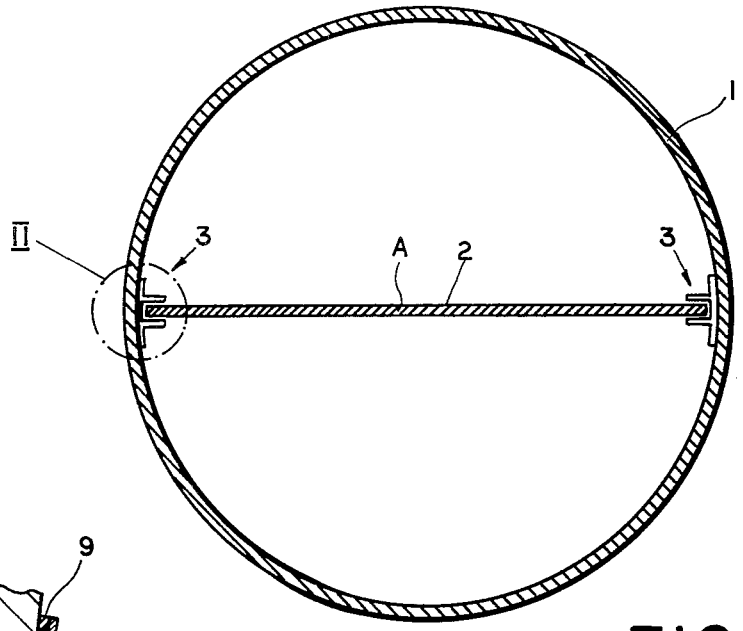
FIG. 1 is a cross section through a heat-exchanger shell according to this invention.
Figure 2:
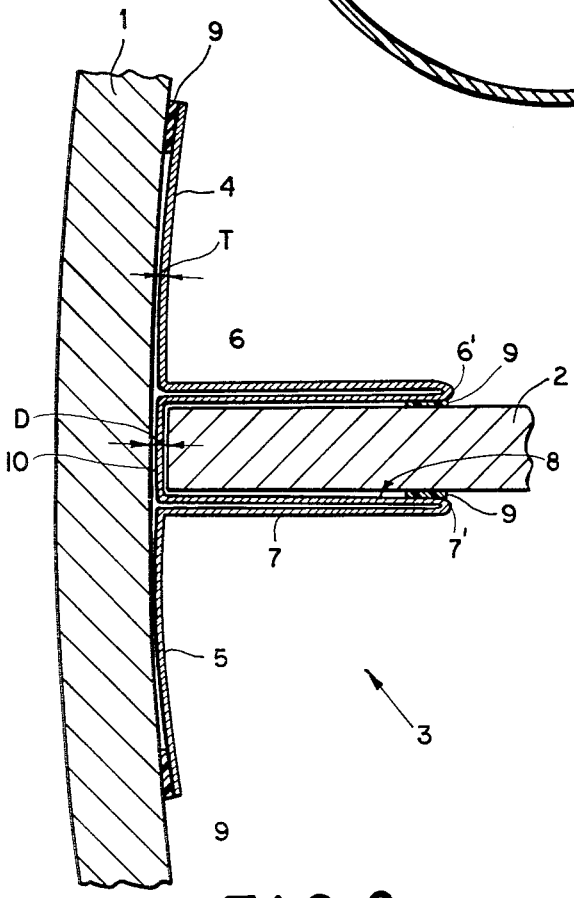
FIG. 2 is a large-scale view of the detail indicated at II in FIG. 1.

As shown in FIGS. 1 and 2, the arrangement according to the present invention basically comprises a cylindrical shell tube 1 centered on an axis A and subdivided into a pair of semicylindrical compartments by a diametrical partition plate 2 provided at its outer edges with seals 3. Inside the two compartments there are provided the normal tube bundles which are not illustrated here, and at the ends of the tubes are provided further seals and manifold arrangements as is well known in the art. Each of the seals 3 basically comprises as shown in FIG. 2 a piece of austenitic sheet steel formed into two outer flanges 4 and 5 that lie on the inner surface of the tube 1 and two inner flanges 6 and 7 that form a groove 8 in which the respective edge of the plate 2 is received. The inner flanges 6 and 7 are substantially the same radial dimension as the angular dimension of the outer flanges 4 and 5. In addition, these inner flanges 6 and 7 are folded over at 6' and 7' so that they are doubled and pass under the edge of the plate 2 at 10. The thickness or gauge T of the steel forming the seal 3 is equal to approximately half of the radial distance D between the outer edge of the plate 2 and the inner surface of the tube 1. Furthermore elastomeric seal strips 9 of synthetic-resin material are provided at the outer longitudinal edges of the flanges 4 and 5 and inside the groove 8 adjacent the folded-over edges 6' and 7'.

Figure 5:
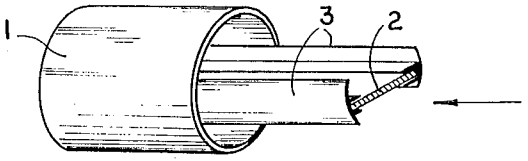
FIG. 5 is a small-scale perspective view illustrating assembly of the partitioned shell of FIG. 1.

The shell of FIG. 1 is assembled as shown in FIG. 5. First the inner flanges 6 and 7 are spread apart to fit the edges of the plate 2 into the groove 8. Then the plate 2 with the seals 3 gripping its outer longitudinal edges is slid axially into the tube 1, which action requires inward radial deflection of the outer flanges 4 and 5.

Figure 4:
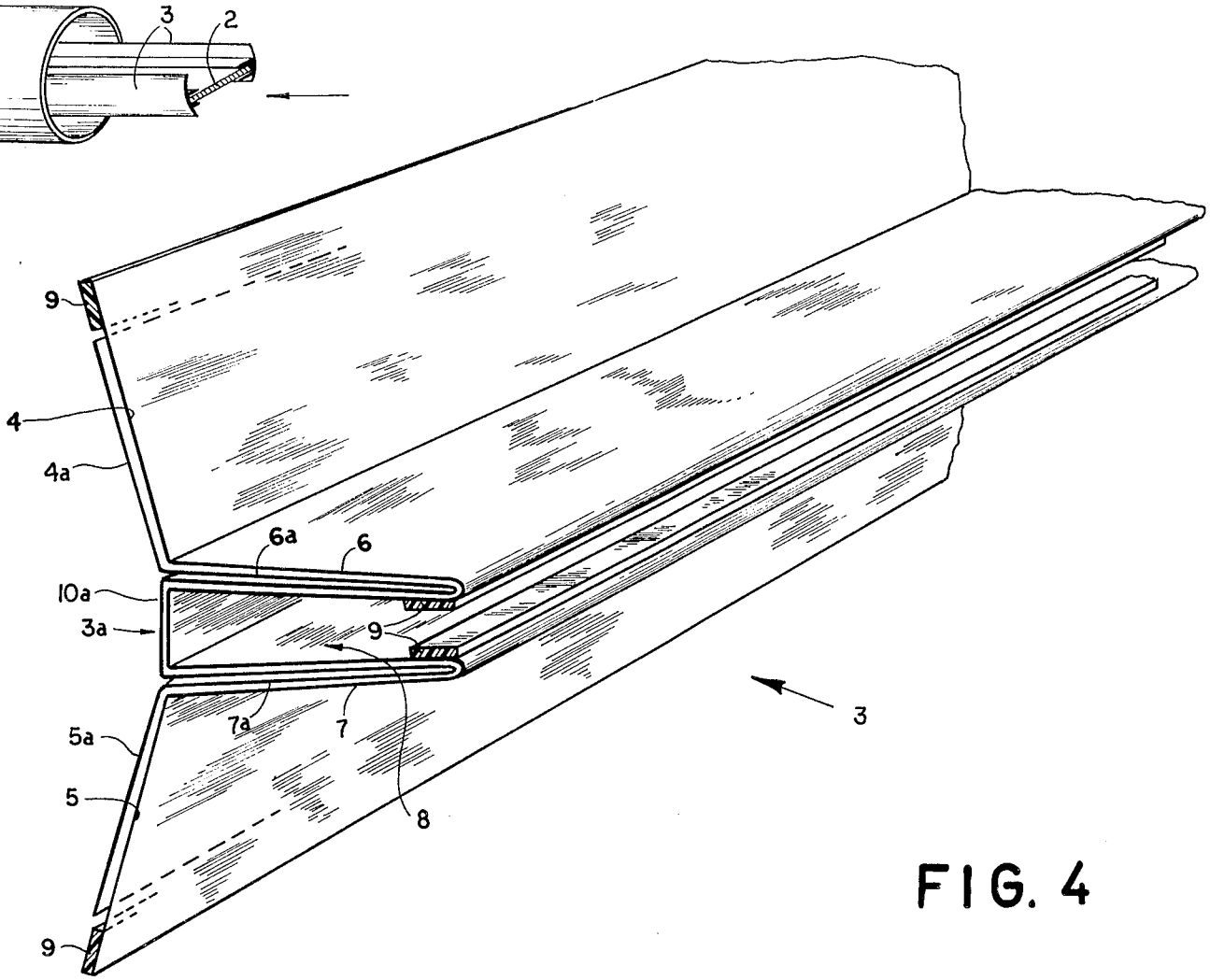
FIG. 4 is a perspective view of the seal of FIG. 2 in unmounted condition and when used in conjunction with another such seal.

FIG. 4 illustrates how in unstressed conditions the flanges 4 and 5 extend at an obtuse angle to each other, flaring away from the inner flanges 6 and 7. Similarly the inner flanges 6 and 7 are inclined inwardly toward each other so that the groove 8 tapers radially inwardly. Thus the entire seal 3 is elastically deformed for assembly of the heat-exchanger shell, ensuring that a very good seal will be produced and that thermal expansion and the like can easily be compensated for. FIG. 4 also shows that it is possible to mount a second such sheet-metal seal 3*a* under the seal 3. The outer flanges of 4*a* and 5*a* of the seal 3*a* are somewhat shorter than the flanges 4 and 5 so that they lie inside the seal strips 9. The flanges 6*a* and 7*a*, however, are of the same radial dimension but the web 10*a* interconnecting them is slightly wider. Thus a stack of such seals can be fitted together to compensate for any variation in plate width, tube diameter, or the like.

Figure 3:
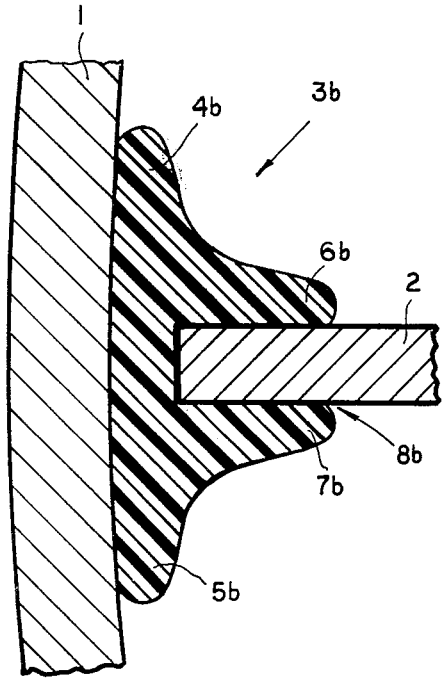
FIG. 3 is a view similar to FIG. 2 illustrating another seal according to this invention.

Finally, FIG. 3 shows how a seal 3*b* can be formed unitarily of elastomeric synthetic-resin material with outer flanges 4*b* and 5*b* and inner flanges 6*b* and 7*b* together forming a groove 8*b*. The resin selected to make the seal 3*b* should be able to withstand the heat or other conditions to which the heat-exchanger will be subjected.

Thus the heat-exchanger shell according to this invention can be assembled in a very simple manner. In spite of such a simple assembly an extremely good seal is provided between the compartments defined in the tube to opposite sides of the partition.

I claim:

1. A heat-exchanger shell comprising:

a substantially cylindrical tube having an inner wall and a central axis;

a substantially flat plate in said tube having a pair of generally parallel edges juxtaposed closely with said inner wall; and a pair of seals each unitarily formed of sheet metal with a pair of generally parallel inner flanges defining a groove in which a respective outer edge of said plate is snugly received with said inner flanges elastically bearing against and gripping the respective edge and a pair of oppositely outwardly extending flanges bearing elastically tightly radially outwardly on said inner wall, said sheet metal being folded over double at said inner flanges and forming a fold at the radially inner edge of each of said inner flanges.

2. The shell defined in claim 1 wherein each of said seals includes a plurality of interleaved geometrically similar sheet metal profiles.

3. The shell defined in claim 1 wherein in an unstressed condition of each of said seals the respective groove is tapered away from said outer flanges whereby said edges are elastically gripped by said inner flanges.

4. The shell defined in claim 1, further comprising an elastomeric seal strip at each of said inner flanges bearing angularly on said plate at said edge thereof.

5. The shell defined in claim 1, further comprising an elastomeric seal strip at each of said outer flanges bearing radially outwardly on said inner wall.

6. A heat exchanger shell comprising:

a substantially cylindrical tube having an inner wall surface and a central axis;

a substantially flat plate in said tube having a pair of generally parallel edges juxtaposed closely with said inner wall surface and having at each edge a pair of side surfaces;

a pair of seals each unitarily formed of sheet metal with a pair of generally parallel inner flanges defining a groove in which a respective outer edge of said plate is received with said inner flanges engaging the respective side surfaces and a pair of oppositely outwardly extending flanges bearing tightly radially outwardly on said inner wall surface; and respective elastomeric seal strips on said seals each between one of the flanges thereof and the respective surface.

* * * * *